US009437968B2

(12) United States Patent
Tada

(10) Patent No.: US 9,437,968 B2
(45) Date of Patent: Sep. 6, 2016

(54) MAGNET CONNECTOR

(71) Applicant: JAPAN AVIATION ELECTRONICS INDUSTRY, LIMITED, Tokyo (JP)

(72) Inventor: Takashi Tada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/513,485

(22) Filed: Oct. 14, 2014

(65) Prior Publication Data

US 2015/0188253 A1 Jul. 2, 2015

(30) Foreign Application Priority Data

Dec. 27, 2013 (JP) ..... 2013-271715

(51) Int. Cl.

| | |
|---|---|
| ***H01R 13/17*** | (2006.01) |
| ***H01R 13/62*** | (2006.01) |
| ***H01R 13/24*** | (2006.01) |
| *H01R 11/30* | (2006.01) |

(52) U.S. Cl.

CPC ..... *H01R 13/6205* (2013.01); *H01R 13/24* (2013.01)

(58) Field of Classification Search

CPC ... H01R 13/6205; H01R 11/30; H01R 13/17
USPC ..... 439/39, 38, 950
See application file for complete search history.

(56) References Cited

U.S. PATENT DOCUMENTS

| | | | | |
|---|---|---|---|---|
| 8,888,500 | B2 * | 11/2014 | Gao et al. | 439/39 |
| 2014/0273546 | A1 * | 9/2014 | Harmon et al. | 439/39 |
| 2015/0194764 | A1 * | 7/2015 | Magana et al. | |

FOREIGN PATENT DOCUMENTS

| | | | | |
|---|---|---|---|---|
| DE | 19512335 | C1 * | 8/1996 | H01R 13/703 |
| JP | H06-342679 | A | 12/1994 | |

OTHER PUBLICATIONS

English Translation of DE 19512335, Fritsch et al., Published Aug. 29, 1996, Translation made Jul. 29, 2015.*

* cited by examiner

*Primary Examiner* — Amy Cohen Johnson
*Assistant Examiner* — Matthew T Dzierzynski
(74) *Attorney, Agent, or Firm* — Collard & Roe, P.C.

(57) ABSTRACT

The receptacle connector comprises a receptacle housing, a receptacle connecting surface, a contact, a first receptacle magnetic pole portion, a second receptacle magnetic pole portion and a third receptacle magnetic pole portion. The plug connector comprises a plug housing, a plug connecting surface, a contact, a first plug magnetic pole portion, a second plug magnetic pole portion and a third plug magnetic pole portion. The first receptacle magnetic pole portion and the first plug magnetic pole portion have opposite magnetic polarities. The second receptacle magnetic pole portion and the third receptacle magnetic pole portion have opposite magnetic polarities. The second plug magnetic pole portion and the third plug magnetic pole portion have opposite magnetic polarities. The second receptacle magnetic pole portion and the second plug magnetic pole portion have opposite magnetic polarities.

8 Claims, 8 Drawing Sheets

(a)

(b)

MAGNET CONNECTOR

This application is based upon and claims the benefit of priority from Japanese Patent Application No. 2013-271715, filed on Dec. 27, 2013, the disclosure of which is incorporated herein in its entirety by reference.

BACKGROUND ART

This invention relates to a magnet connector comprising a receptacle connector and a plug connector and, in particular, relates to a magnet connector which, using magnets, allows a receptacle connector and a plug connector to be attracted to each other and held in a connected state by a magnetic force, thereby facilitating the connection between the connectors.

This type of magnet connector is disclosed in, for example, JP-A-H6-342679 (related art document).

FIG. 8 shows a magnet connector disclosed in the related art document, wherein a pin connector 1 is provided with a plurality of pin contacts 6 each biased by a compression spring, while a cable connector 2 is provided with a plurality of belt-like contacts 11. Magnets 7 having an L-shape in plan view are provided at both ends of the pin connector 1, while magnets 14 having an L-shape in plan view are provided at both ends of the cable connector 2. The shapes of the magnets 7 and the magnets 14 are such that when the pin connector 1 and the cable connector 2 face each other, the magnets 7 and the corresponding magnets 14 are fitted to each other. Each of the magnets 7 and 14 has a pair of surfaces with different magnetic polarities.

The pin connector 1 and the cable connector 2 are connected to each other in the following manner: As the connectors 1 and 2 approach each other, first, the lateral position offset therebetween is corrected by magnetic repulsion between the surfaces, with the same polarity, of each magnet 7 and the corresponding magnet 14 and, then, when the connectors 1 and 2 further approach each other, an attraction force is exerted between the facing surfaces of the magnets 7 and the magnets 14 due to the opposite magnetic polarities so that the pin contacts 6 and the belt-like contacts 11 are brought into contact with each other in a state where the connectors 1 and 2 are accurately positioned laterally.

However, in this type of magnet connector, including the above-mentioned magnet connector disclosed in the related art document, since contacts of a receptacle connector and a plug connector are brought into point contact with each other, there is a possibility that, over the use of the magnet connector, dirt adheres to surfaces of the contacts or an oxide film is formed on surfaces of the contacts to increase the electrical resistance between the contacts, resulting in contact failure. In order to solve this problem, it is preferable to periodically carry out maintenance operations to clean the surfaces of the contacts. However, such maintenance operations will be a burden on a user.

DISCLOSURE OF THE INVENTION

It is therefore an object of this invention to provide a magnet connector which allows contacts of a receptacle connector and a plug connector to be automatically wiped in the process of inserting the plug connector into the receptacle connector to establish connection therebetween.

According to an aspect of this invention, there is provided a magnet connector which allows a plug connector, inserted into a receptacle connector, to be attracted to the receptacle connector and held in a connected state by a magnetic force.

The receptacle connector comprises a receptacle housing having a recessed portion, a receptacle connecting surface as a bottom surface of the recessed portion of the receptacle housing, a contact provided at the receptacle connecting surface, and a first receptacle magnetic pole portion provided on the receptacle connecting surface. The plug connector comprises a plug housing adapted to be inserted into the recessed portion of the receptacle connector, a plug connecting surface, as an insertion front surface of the plug housing, adapted to be connected to the receptacle connecting surface of the receptacle connector, a contact provided at the plug connecting surface, and a first plug magnetic pole portion provided on the plug connecting surface at a position adapted to face the first receptacle magnetic pole portion of the receptacle connector. A biasing means is provided on a side of one of the contact provided at the receptacle connecting surface and the contact provided at the plug connecting surface. The first receptacle magnetic pole portion and the first plug magnetic pole portion have opposite magnetic polarities. The receptacle connector further comprises a second receptacle magnetic pole portion provided in a region, close to the receptacle connecting surface, of a first receptacle wall surface as an inner wall surface of the recessed portion of the receptacle housing, and a third receptacle magnetic pole portion provided in a region, farther from the receptacle connecting surface compared to the second receptacle magnetic pole portion, of the first receptacle wall surface. The plug connector further comprises a second plug magnetic pole portion provided in a region, close to the plug connecting surface, of a first plug side surface which faces the first receptacle wall surface when inserted into the receptacle connector, and a third plug magnetic pole portion provided in a region, farther from the plug connecting surface compared to the second plug magnetic pole portion, of the first plug side surface. The second receptacle magnetic pole portion and the third receptacle magnetic pole portion have opposite magnetic polarities. The second plug magnetic pole portion and the third plug magnetic pole portion have opposite magnetic polarities. The second receptacle magnetic pole portion and the second plug magnetic pole portion have opposite magnetic polarities.

In the magnet connector, one of the contact provided at the receptacle connecting surface and the contact provided at the plug connecting surface may be a pin contact with a protruding tip. The other of the contact provided at the receptacle connecting surface and the contact provided at the plug connecting surface may be a planar contact.

In the magnet connector, the biasing means may be provided on the pin contact.

In the magnet connector, the first receptacle magnetic pole portion and the second receptacle magnetic pole portion may have the same magnetic polarity. The first plug magnetic pole portion and the second plug magnetic pole portion may have the same magnetic polarity.

In the magnet connector, the receptacle connector may further comprise a fourth receptacle magnetic pole portion provided in a region, close to the receptacle connecting surface, of a second receptacle wall surface, located on a side opposite to the first receptacle wall surface, of the recessed portion, and a fifth receptacle magnetic pole portion provided in a region, farther from the receptacle connecting surface compared to the fourth receptacle magnetic pole portion, of the second receptacle wall surface. The plug connector may further comprise a fourth plug magnetic pole portion provided in a region, close to the plug connecting surface, of a second plug side surface located on a side opposite to the first plug side surface and adapted to face the second receptacle wall surface when inserted into the receptacle connector, and a fifth plug magnetic pole portion provided in a region, farther from the plug connecting surface compared to the fourth plug magnetic pole portion, of the second plug side surface. The fourth receptacle magnetic pole portion and the fifth receptacle magnetic pole portion may have opposite magnetic polarities. The fourth plug magnetic pole portion and the fifth plug magnetic pole portion may have opposite magnetic polarities. The fourth receptacle magnetic pole portion and the fourth plug magnetic pole portion may have the same magnetic polarity.

In the magnet connector, the receptacle connector may further comprise a sixth receptacle magnetic pole portion provided on the receptacle connecting surface. The plug connector may further comprise a sixth plug magnetic pole portion provided on the plug connecting surface at a position adapted to face the sixth receptacle magnetic pole portion. The first receptacle magnetic pole portion and the sixth receptacle magnetic pole portion may have opposite magnetic polarities. The sixth receptacle magnetic pole portion and the sixth plug magnetic pole portion may have opposite magnetic polarities.

In the magnet connector, the receptacle housing may comprise a receptacle insulating housing piece made of an electrically insulating material and provided with the contact, and a receptacle magnetic housing piece made of a magnetic material and having a frame shape defining the recessed portion, the receptacle magnetic housing piece having the receptacle connecting surface formed with a cutout portion which exposes the contact and part of the receptacle insulating housing piece. The first to sixth receptacle magnetic pole portions may be formed integrally with the receptacle magnetic housing piece by locally magnetizing corresponding portions on the receptacle magnetic housing piece. The plug housing may comprise a plug insulating housing piece made of an electrically insulating material and provided with the contact, and a plug magnetic housing piece made of a magnetic material and having the plug connecting surface formed with a cutout portion which exposes the contact and part of the plug insulating housing piece. The first to sixth plug magnetic pole portions may be formed integrally with the plug magnetic housing piece by locally magnetizing corresponding portions on the plug magnetic housing piece.

EMBODIMENTS

Figure 1:
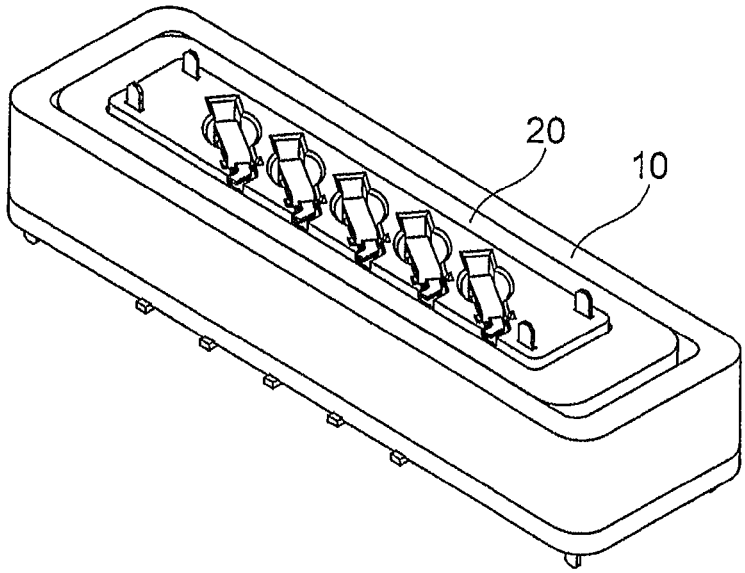
FIG. 1 is a perspective view showing a magnet connector according to an embodiment of this invention, wherein (a) is a perspective view seen from above and (b) is a perspective view seen from below.
Figure 1:
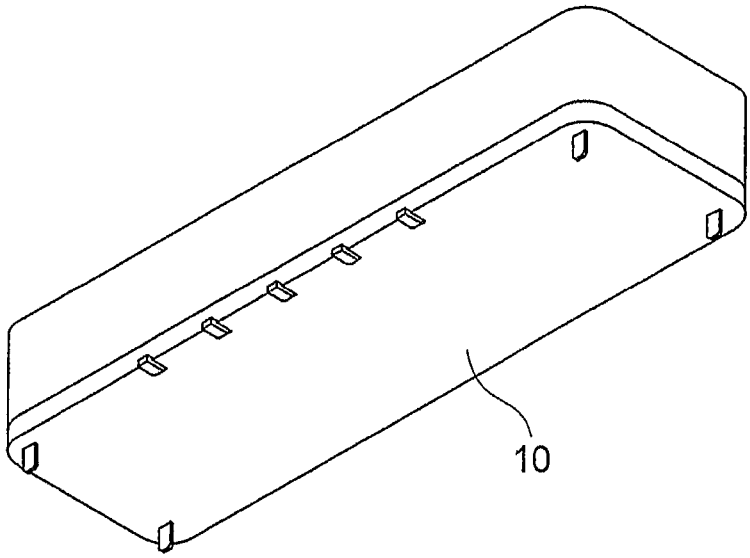

A magnet connector according to this invention is a magnet connector which allows a plug connector, inserted into a receptacle connector, to be attracted to the receptacle connector and held in a connected state by a magnetic force. In this magnet connector, the receptacle connector comprises a receptacle housing having a recessed portion; a receptacle connecting surface as a bottom surface of the recessed portion of the receptacle housing; a planar contact having a planar shape and provided at the receptacle connecting surface; and a first receptacle magnetic pole portion provided on the receptacle connecting surface. On the other hand, the plug connector comprises a plug housing adapted to be inserted into the recessed portion of the receptacle connector; a plug connecting surface, as an insertion front surface of the plug housing, adapted to be connected to the receptacle connecting surface of the receptacle connector; a pin contact provided at the plug connecting surface and having a biasing means for biasing it in a direction of insertion into the receptacle connector; and a first plug magnetic pole portion provided on the plug connecting surface at a position adapted to face the first receptacle magnetic pole portion of the receptacle connector. The first receptacle magnetic pole portion and the first plug magnetic pole portion have opposite magnetic polarities.

In this magnet connector, particularly, the receptacle connector further comprises a second receptacle magnetic pole portion provided in a region, close to the receptacle connecting surface, of a first receptacle wall surface as an inner wall surface of the recessed portion of the receptacle housing; and a third receptacle magnetic pole portion provided in a region, farther from the receptacle connecting surface compared to the second receptacle magnetic pole portion, of the first receptacle wall surface.

On the other hand, the plug connector further comprises a second plug magnetic pole portion provided in a region, close to the plug connecting surface, of a first plug side surface which faces the first receptacle wall surface when inserted into the receptacle connector; and a third plug magnetic pole portion provided in a region, farther from the plug connecting surface compared to the second plug magnetic pole portion, of the first plug side surface.

The second receptacle magnetic pole portion and the third receptacle magnetic pole portion have opposite magnetic polarities, the second plug magnetic pole portion and the third plug magnetic pole portion have opposite magnetic polarities, and the second receptacle magnetic pole portion and the second plug magnetic pole portion have opposite magnetic polarities.

The magnet connector according to this invention operates in the following manner:

In an initial stage of insertion of the plug connector into the receptacle connector in order to establish connection therebetween, the position offset of the plug connector with respect to the receptacle connector occurs in a direction crossing a connector connecting direction by magnetic repulsion due to the same magnetic polarity between the third receptacle magnetic pole portion and the second plug magnetic pole portion. Since the movement range of the plug connector is limited by the recessed portion of the receptacle connector, the plug connector does not move beyond a predetermined offset position. In this initial insertion stage, the pin contact with the biasing means of the plug connector is already brought into contact with the planar contact of the receptacle connector due to a retraction margin of the biasing means, i.e. such as a spring.

Subsequently, in an advanced insertion stage where the plug connector is further inserted into the receptacle connector, the plug connector starts to move in an opposite direction from the offset position in the direction crossing the connector connecting direction and continues to move until the first plug side surface of the plug connector is brought into contact with the first receptacle wall surface of the receptacle connector by magnetic attraction due to the opposite magnetic polarities between the second receptacle magnetic pole portion and the second plug magnetic pole portion and between the third receptacle magnetic pole portion and the third plug magnetic pole portion. That is, with the movement of the plug connector, the pin contact of the plug connector wipes the planar contact of the receptacle connector.

Thereafter, by magnetic attraction due to the opposite magnetic polarities between the first receptacle magnetic pole portion and the first plug magnetic pole portion, the insertion of the plug connector into the receptacle connector is completed and the connected state of the connectors is held.

When removing the plug connector from the receptacle connector, the plug connector is pulled out of the receptacle connector with a force overcoming the force of attraction due to the opposite magnetic polarities of the first receptacle magnetic pole portion and the first plug magnetic pole portion in the same manner as in the case of the conventional magnet connector. In this event, a case may occur in a final removal stage where the position offset of the plug connector with respect to the receptacle connector occurs in a direction crossing the connector connecting direction by magnetic repulsion due to the same magnetic polarity between the third receptacle magnetic pole portion and the second plug magnetic pole portion. However, in this case, wiping is carried out also in the removal of the plug connector.

With the structure described above, the magnet connector according to this invention is such that even if dirt adheres to surfaces of the planar contact or the pin contact, since the dirt is removed by wiping, it is prevented that the contact reliability is impaired, i.e. that the contact resistance increases.

Hereinbelow, a more specific embodiment of a magnet connector according to this invention will be described with reference to the drawings.

[Basic Structure]

Referring to FIGS. 1 to 5, a magnet connector according to an embodiment of this invention allows a plug connector 20, inserted into a receptacle connector 10, to be attracted to the receptacle connector 10 and held in a connected state by a magnetic force.

Figure 2:
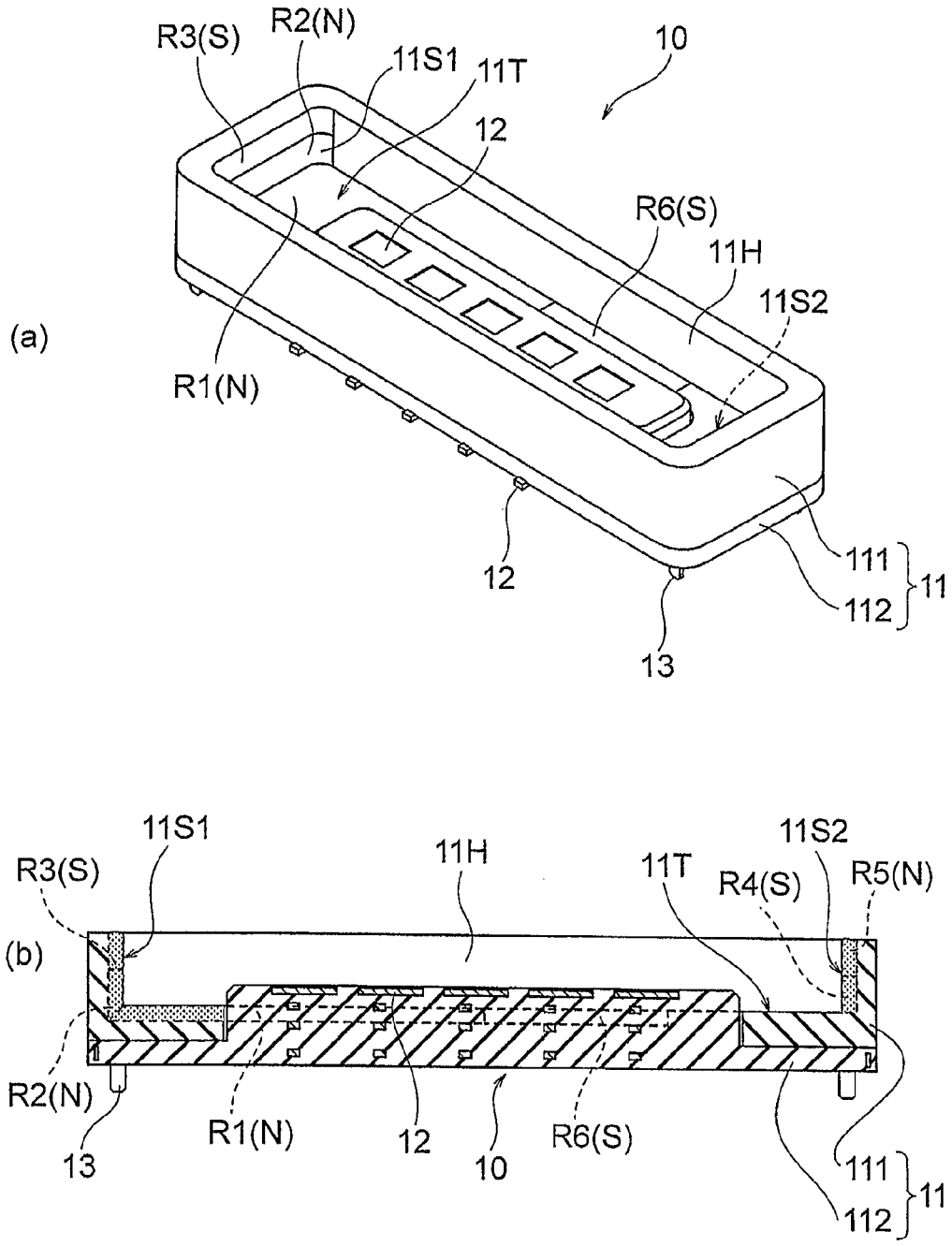
FIG. 2 is a diagram showing a receptacle connector of the magnet connector shown in FIG. 1, wherein (a) is a perspective view and (b) is a cross-sectional view.
Figure 3:
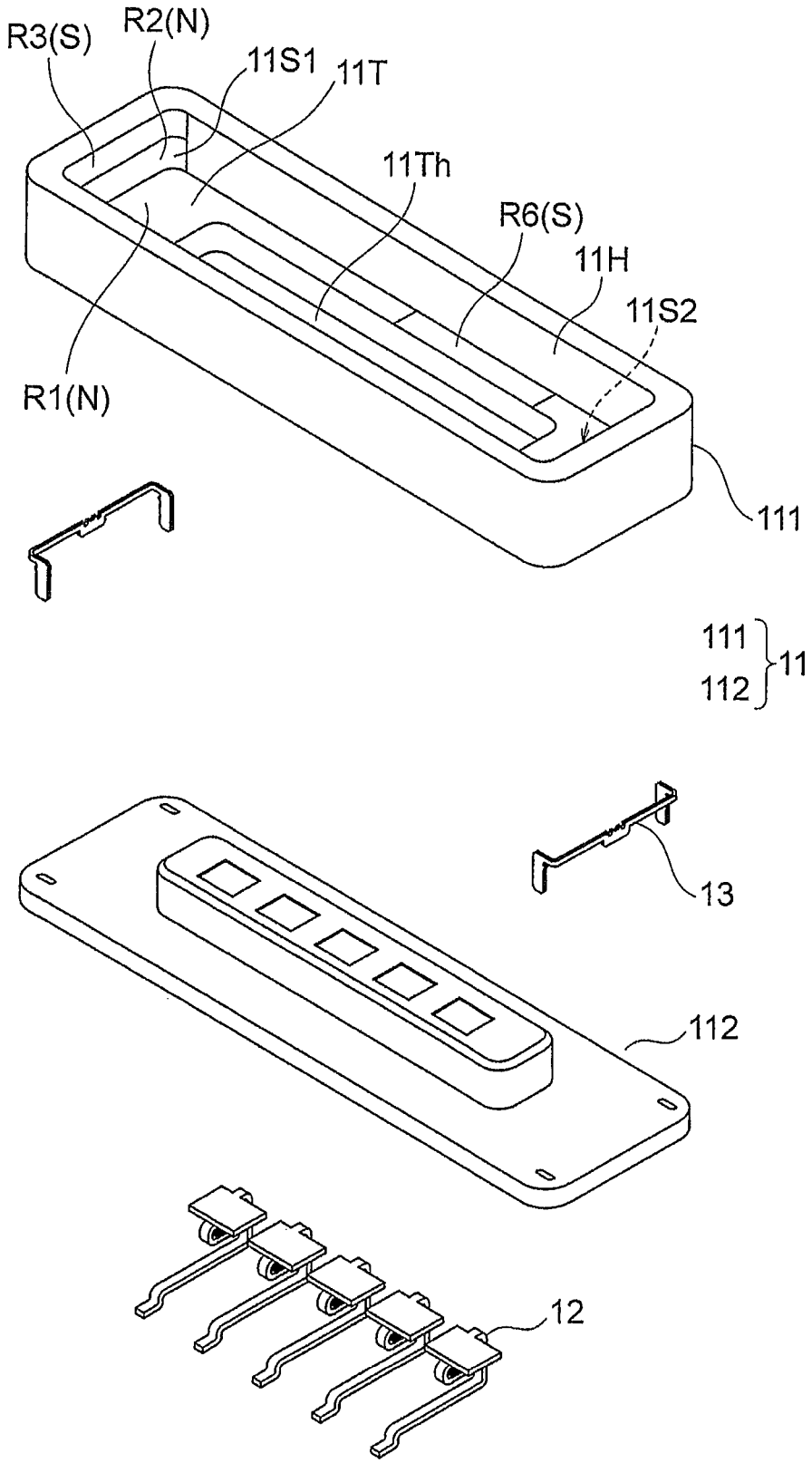
FIG. 3 is an exploded perspective view of the receptacle connector shown in FIG. 2.

In this magnet connector, as shown at (a) and (b) in FIG. 2 and in FIG. 3, the receptacle connector 10 comprises a receptacle housing 11 having a recessed portion 11H, a receptacle connecting surface 11T as a bottom surface of the recessed portion 11H of the receptacle housing 11, a plurality of planar contacts 12 having a planar shape and provided at the receptacle connecting surface 11T, and a first receptacle magnetic pole portion R1 provided on the receptacle connecting surface 11T.

Figure 4:
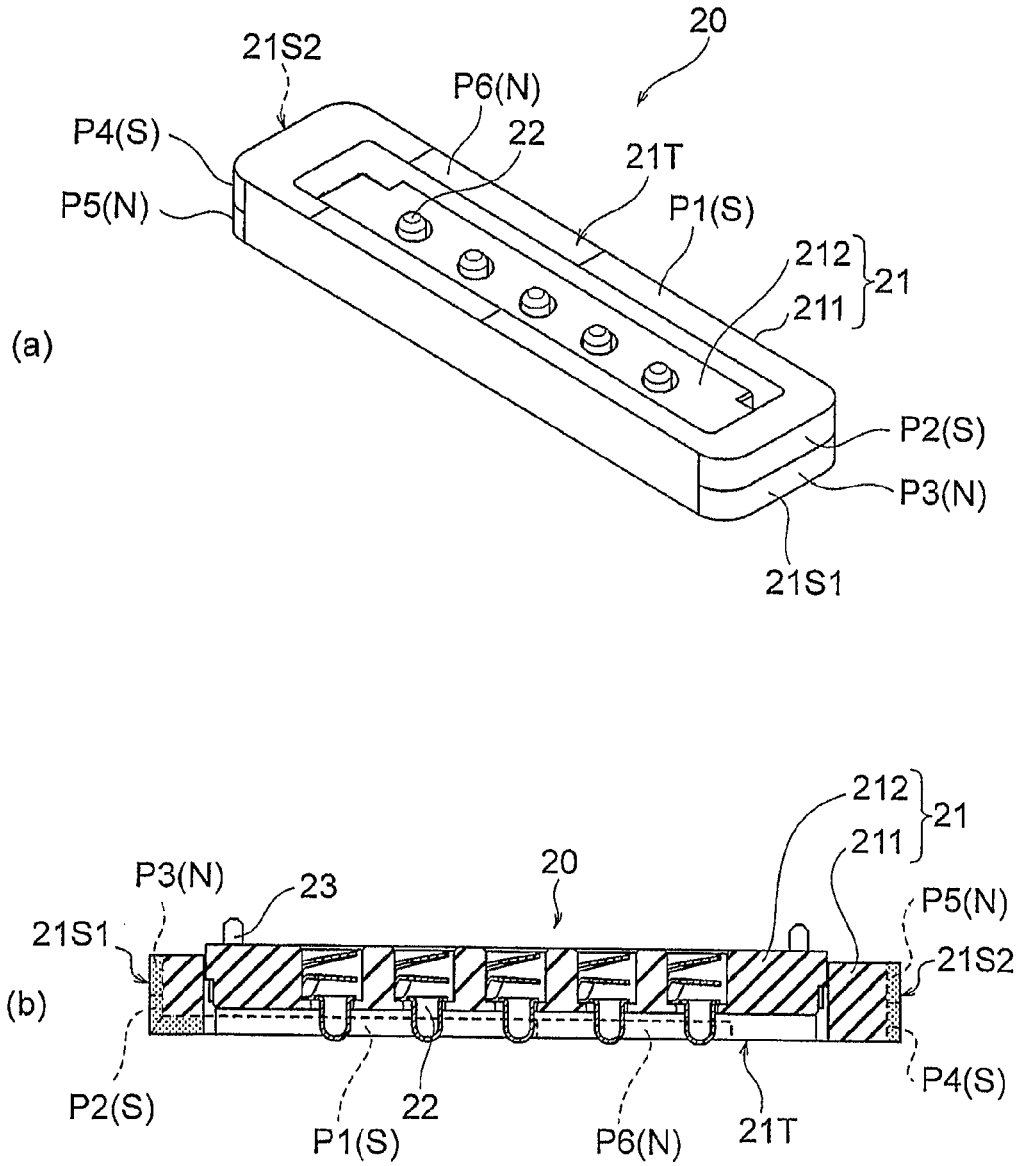
FIG. 4 is a diagram showing a plug connector of the magnet connector shown in FIG. 1, wherein (a) is a perspective view and (b) is a cross-sectional view.
Figure 5:
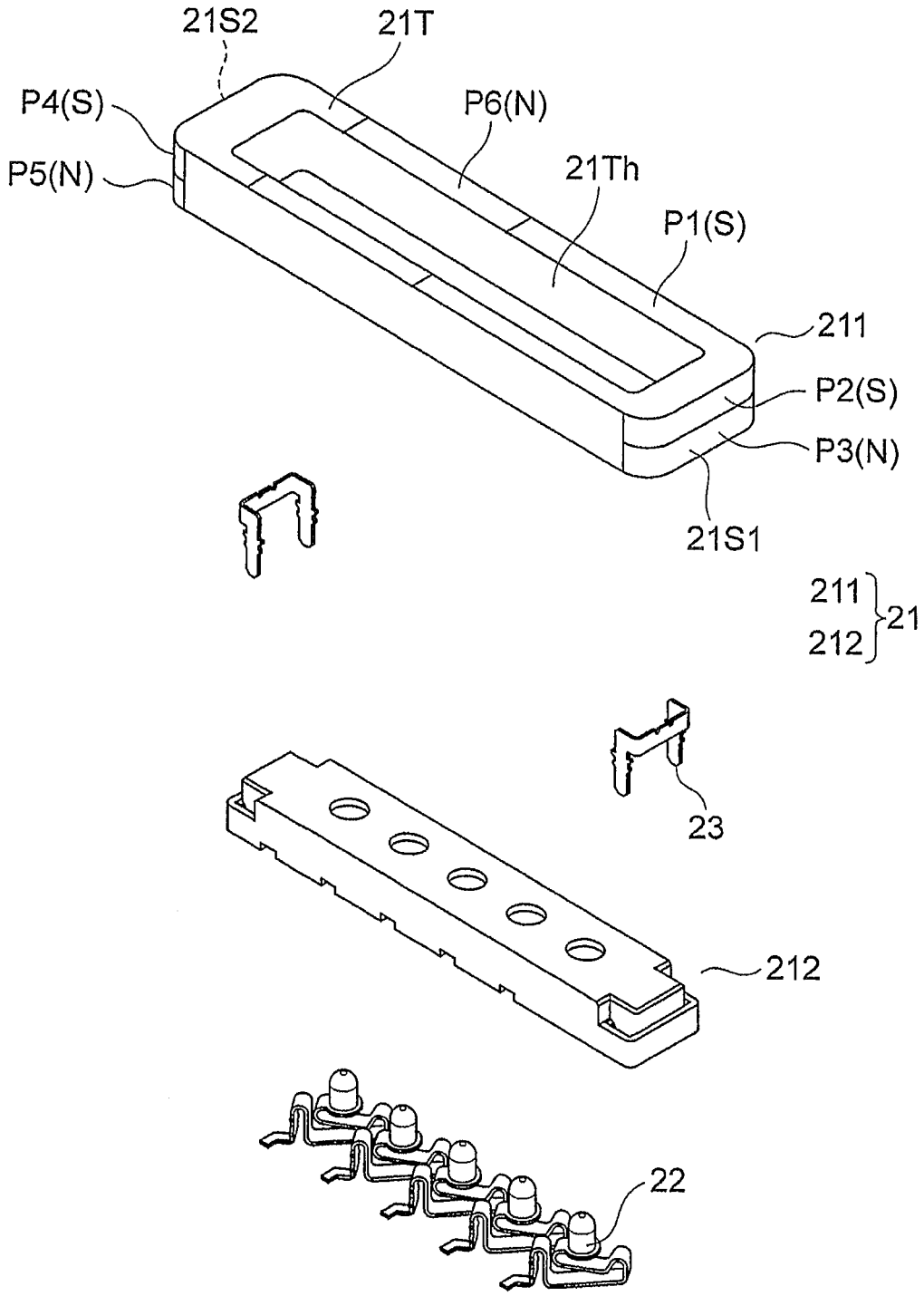
FIG. 5 is an exploded perspective view of the plug connector shown in FIG. 4.

On the other hand, as shown at (a) and (b) in FIG. 4 and in FIG. 5, the plug connector 20 comprises a plug housing 21 adapted to be inserted into the recessed portion 11H of the receptacle connector 10, a plug connecting surface 21T, as an insertion front surface of the plug housing 21, adapted to be connected to the receptacle connecting surface 11T of the receptacle connector 10, a plurality of pin contacts 22 provided at the plug connecting surface 21T and each having a biasing means for biasing it in a direction of insertion into the receptacle connector 10, and a first plug magnetic pole portion P1 provided on the plug connecting surface 21T at a position adapted to face the first receptacle magnetic pole portion R1 of the receptacle connector 10.

The first receptacle magnetic pole portion R1 and the first plug magnetic pole portion P1 have opposite magnetic polarities. In this embodiment, the first receptacle magnetic pole portion R1 is an N-pole while the first plug magnetic pole portion P1 is an S-pole.

In this invention, particularly, as shown at (a) and (b) in FIG. 2 and in FIG. 3, the receptacle connector 10 further comprises a second receptacle magnetic pole portion R2 provided in a region, close to the receptacle connecting surface 11T, of a first receptacle wall surface 11S1 which is one of inner wall surfaces of the recessed portion 11H of the receptacle housing 11, and a third receptacle magnetic pole portion R3 provided in a region, farther from the receptacle connecting surface 11T compared to the second receptacle magnetic pole portion R2, of the first receptacle wall surface 11S1.

On the other hand, as shown at (a) and (b) in FIG. 4 and in FIG. 5, the plug connector 20 further comprises a second plug magnetic pole portion P2 provided in a region, close to the plug connecting surface 21T, of a first plug side surface 21S1 which faces the first receptacle wall surface 11S1 when inserted into the receptacle connector 10, and a third plug magnetic pole portion P3 provided in a region, farther from the plug connecting surface 21T compared to the second plug magnetic pole portion P2, of the first plug side surface 21S1.

The second receptacle magnetic pole portion R2 and the third receptacle magnetic pole portion R3 have opposite magnetic polarities. The second plug magnetic pole portion P2 and the third plug magnetic pole portion P3 have opposite magnetic polarities. Further, the second receptacle magnetic pole portion R2 and the second plug magnetic pole portion P2 have opposite magnetic polarities. In this embodiment, the second receptacle magnetic pole portion R2 and the third plug magnetic pole portion P3 are N-poles while the third receptacle magnetic pole portion R3 and the second plug magnetic pole portion P2 are S-poles.

The first receptacle magnetic pole portion R1 and the second receptacle magnetic pole portion R2 have the same magnetic polarity (N-polarity in this embodiment). Further, the first plug magnetic pole portion P1 and the second plug magnetic pole portion P2 have the same magnetic polarity (S-polarity in this embodiment).

[Fourth and Fifth Magnetic Pole Portions]

As shown at (a) and (b) in FIG. 2 and in FIG. 3, the receptacle connector 10 further comprises a fourth receptacle magnetic pole portion R4 provided in a region, close to the receptacle connecting surface 11T, of a second receptacle wall surface 11S2, located on the side opposite to the first receptacle wall surface 11S1, of the recessed portion 11H, and a fifth receptacle magnetic pole portion R5 provided in a region, farther from the receptacle connecting surface 11T compared to the fourth receptacle magnetic pole portion R4, of the second receptacle wall surface 11S2.

On the other hand, as shown at (a) and (b) in FIG. 4 and in FIG. 5, the plug connector 20 further comprises a fourth plug magnetic pole portion P4 provided in a region, close to the plug connecting surface 21T, of a second plug side surface 21S2 located on the side opposite to the first plug side surface 21S1 and adapted to face the second receptacle wall surface 11S2 when inserted into the receptacle connector 10, and a fifth plug magnetic pole portion P5 provided in a region, farther from the plug connecting surface 21T compared to the fourth plug magnetic pole portion P4, of the second plug side surface 21S2.

The fourth receptacle magnetic pole portion R4 and the fifth receptacle magnetic pole portion R5 have opposite magnetic polarities. The fourth plug magnetic pole portion P4 and the fifth plug magnetic pole portion P5 have opposite magnetic polarities. Further, the fourth receptacle magnetic pole portion R4 and the fourth plug magnetic pole portion P4 have the same magnetic polarity. In this embodiment, the fourth receptacle magnetic pole portion R4 and the fourth plug magnetic pole portion P4 are S-poles while the fifth receptacle magnetic pole portion R5 and the fifth plug magnetic pole portion P5 are N-poles.

[Sixth Magnetic Pole Portion]

Further, as shown at (a) and (b) in FIG. 2 and in FIG. 3, the receptacle connector 10 further comprises a pair of sixth receptacle magnetic pole portions R6 provided on the receptacle connecting surface 11T.

On the other hand, as shown at (a) and (b) in FIG. 4 and in FIG. 5, the plug connector 20 further comprises a pair of sixth plug magnetic pole portions P6 provided on the plug connecting surface 21T at positions adapted to face the sixth receptacle magnetic pole portions R6 of the receptacle connector 10.

The first receptacle magnetic pole portion R1 and the sixth receptacle magnetic pole portions R6 have opposite magnetic polarities. Further, the sixth receptacle magnetic pole portions R6 and the sixth plug magnetic pole portions P6 have opposite magnetic polarities. In this embodiment, the sixth receptacle magnetic pole portions R6 are S-poles while the sixth plug magnetic pole portions P6 are N-poles.

This combination of the sixth receptacle magnetic pole portions R6 and the sixth plug magnetic pole portions P6, cooperatively with the combination of the first receptacle magnetic pole portion R1 and the first plug magnetic pole portion P1, can prevent erroneous insertion in which the plug connector 20 is inserted with wrong orientation into the receptacle connector 10.

[Integral Structure of Part of Housing and Magnetic Pole Portion]

As shown in FIG. 3, the receptacle housing 11 comprises a receptacle insulating housing piece 112 and a receptacle magnetic housing piece 111.

The receptacle insulating housing piece 112 is made of an electrically insulating material. In this embodiment, five planar contacts 12 are held by the receptacle insulating housing piece 112 and a pair of metal fittings 13 are press-fitted thereinto.

The receptacle magnetic housing piece 111 is made of a magnetic material and has a frame shape defining the recessed portion 11H. The receptacle magnetic housing piece 111 has the receptacle connecting surface 11T. The receptacle connecting surface 11T is formed with a cutout portion 11Th which exposes the planar contacts 12 and part of the receptacle insulating housing piece 112.

Each planar contact 12 comprises a contact portion of a flat plate shape and a lead portion formed integrally with the contact portion. In FIG. 3, the lead portion is illustrated to extend in a substantially straight line. However, actually, the lead portion is formed, by insert molding or the like, into a zigzag shape in which the lead portion is bent a plurality of times in the receptacle insulating housing piece 112. Such a shape enhances water resistance.

Each metal fitting 13 has leg portions at its both ends. The leg portions are press-fitted into slits formed through the receptacle insulating housing piece 112 and distal ends of the leg portions protrude from a bottom surface of the receptacle connector 10 along with distal ends of the lead portions of the planar contacts 12. The distal ends of the leg portions of the metal fittings 13 and the distal ends of the lead portions of the planar contacts 12 are used for soldering to a circuit board or the like of an electronic device such as an information processing terminal.

The first to sixth receptacle magnetic pole portions R1 to R6 are formed integrally with the receptacle magnetic housing piece 111 by locally magnetizing corresponding portions on the receptacle magnetic housing piece 111. The technique of magnetizing a plurality of arbitrary portions of a single magnetic member (receptacle magnetic housing piece 111) to arbitrary magnetic polarities, respectively, is already known.

Alternatively, the first to sixth receptacle magnetic pole portions R1 to R6 may be formed by attaching individual magnet pieces to a housing made of an electrically insulating material.

On the other hand, as shown in FIG. 5, the plug housing 21 comprises a plug insulating housing piece 212 and a plug magnetic housing piece 211.

The plug insulating housing piece 212 is made of an electrically insulating material. In this embodiment, five pin contacts 22 are held by the plug insulating housing piece 212 so as to be reciprocatable and a pair of metal fittings 23 are press-fitted into the plug insulating housing piece 212.

The plug magnetic housing piece 211 is made of a magnetic material and has the plug connecting surface 21T. The plug connecting surface 21T is formed with a cutout portion 21Th which exposes the pin contacts 22 and part of the plug insulating housing piece 212.

Each pin contact 22 comprises a contact portion of a probe shape and a lead portion formed integrally with the contact portion. The lead portion is formed, by insert molding or the like, into a zigzag shape of being bent a plurality of times and has elasticity. That is, in this embodiment, the lead portion of the pin contact 22 serves as a biasing means for biasing the contact portion of the pin contact 22 in the direction of insertion into the receptacle connector 10. In this invention, a pin contact is not limited to the pin contact comprising the contact portion and the biasing means formed integrally with each other as in this embodiment, but may alternatively be a pin contact, such as a so-called pogo pin, comprising a contact portion of a probe or needle shape and a separate biasing means such as a coil spring. Further, in this invention, a contact is not limited to the pin contact with the protruding tip as in this embodiment, but may alternatively be any other contact as long as it is given a retraction margin by a biasing means.

Each metal fitting 23 has leg portions at its both ends. The leg portions are press-fitted into slits formed through the plug insulating housing piece 212 and distal ends of the leg portions protrude from a back surface of the plug connector 20 along with distal ends of the lead portions of the pin contacts 22. The distal ends of the leg portions of the metal fittings 23 and the distal ends of the lead portions of the pin contacts 22 are used for soldering to a circuit board or the like of an electronic device or an electronic instrument, such as a peripheral device for an information processing terminal or a cable connector.

The first to sixth plug magnetic pole portions P1 to P6 are formed integrally with the plug magnetic housing piece 211 by locally magnetizing corresponding portions on the plug magnetic housing piece 211. The technique of magnetizing a plurality of arbitrary portions of a single magnetic member (plug magnetic housing piece 211) to arbitrary magnetic polarities, respectively, is already known.

Alternatively, the first to sixth plug magnetic pole portions P1 to P6 may be formed by attaching individual magnet pieces to a housing made of an electrically insulating material.

[Operation]

Next, the operation of the magnet connector according to this embodiment will be described.

Figure 6:
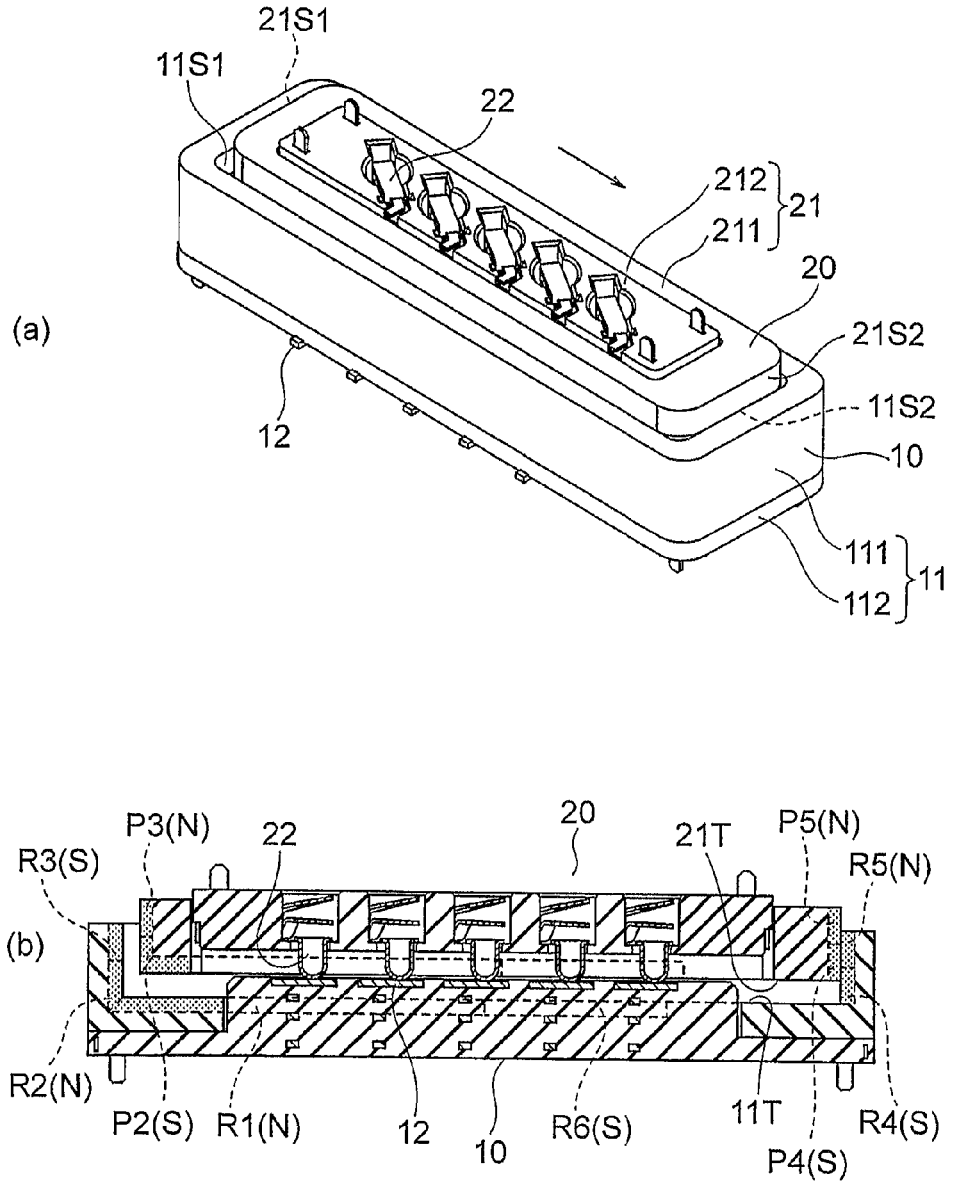
FIG. 6 is a diagram for explaining the operation of the magnet connector shown in FIG. 1, wherein (a) is a perspective view of an initial stage of insertion of the plug connector into the receptacle connector and (b) is a cross-sectional view of the same.

As shown at (a) and (b) in FIG. 6, in an initial stage of insertion of the plug connector 20 into the receptacle connector 10 in order to establish connection therebetween, the position offset of the plug connector 20 with respect to the receptacle connector 10 occurs in a direction crossing the connector connecting direction by magnetic repulsion due to the same magnetic polarity between the third receptacle magnetic pole portion R3 (S-pole) and the second plug magnetic pole portion P2 (S-pole) and by magnetic attraction due to the opposite magnetic polarities between the fifth receptacle magnetic pole portion R5 (N-pole) and the fourth plug magnetic pole portion P4 (S-pole). Since the movement range of the plug connector 20 is limited by the recessed portion 11H of the receptacle connector 10, the plug connector 20 does not move beyond a predetermined offset position. In this initial insertion stage, the pin contacts 22 with the biasing means of the plug connector 20 are already brought into contact with the planar contacts 12 of the receptacle connector 10 due to a retraction margin of the biasing means, i.e. such as a spring.

Subsequently, in an advanced insertion stage where the plug connector 20 is further inserted into the receptacle connector 10, the plug connector 20 starts to move in an opposite direction from the offset position in the direction crossing the connector connecting direction and continues to move until the first plug side surface 21S1 of the plug connector 20 is brought into contact with the first receptacle wall surface 11S1 of the receptacle connector 10 by magnetic attraction due to the opposite magnetic polarities between the second receptacle magnetic pole portion R2 (N-pole) and the second plug magnetic pole portion P2 (S-pole) and between the third receptacle magnetic pole portion R3 (S-pole) and the third plug magnetic pole portion P3 (N-pole) (or, in addition thereto, by magnetic repulsion due to the same magnetic polarity between the fourth receptacle magnetic pole portion R4 (S-pole) and the fourth plug magnetic pole portion P4 (S-pole) and between the fifth receptacle magnetic pole portion R5 (N-pole) and the fifth plug magnetic pole portion P5 (N-pole)). That is, with the movement of the plug connector 20, the pin contacts 22 of the plug connector 20 wipe the planar contacts 12 of the receptacle connector 10.

Figure 7:
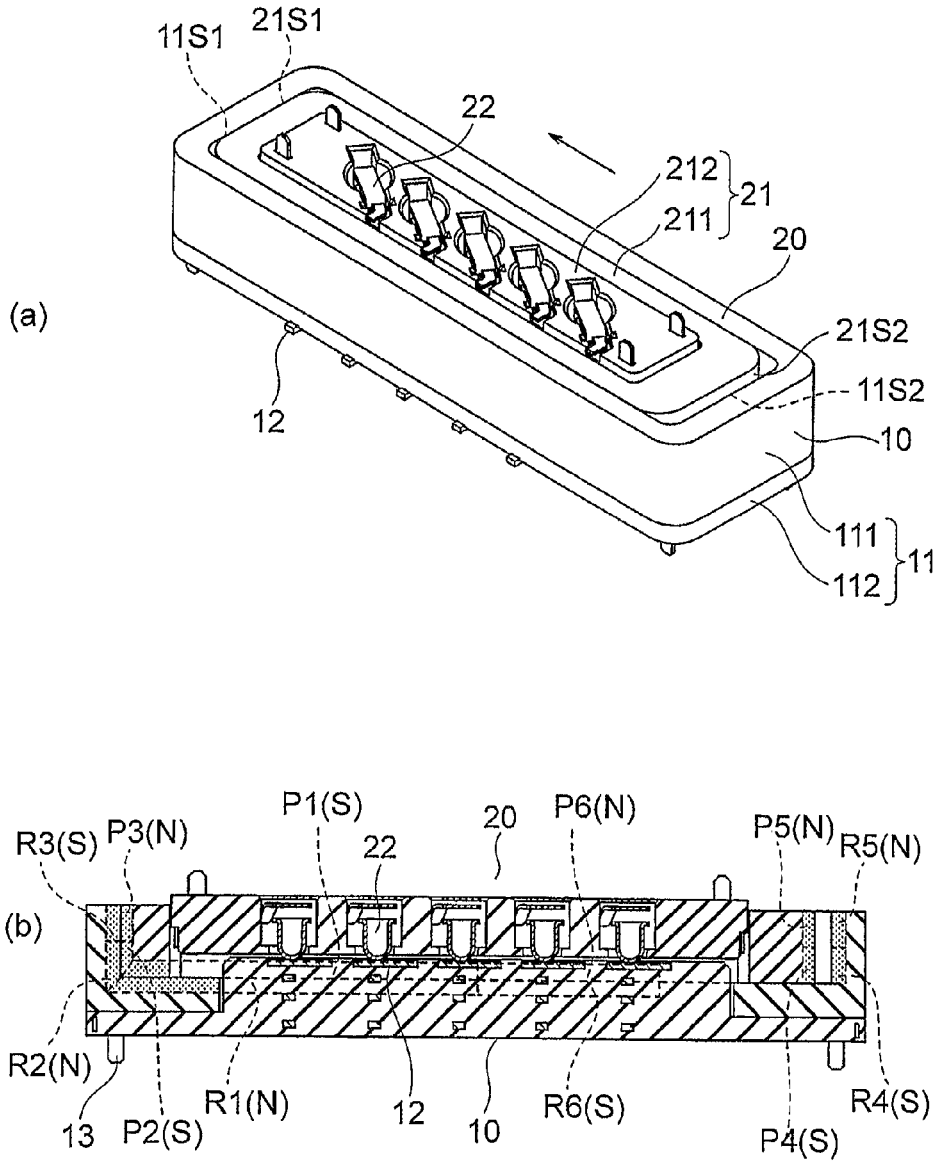
FIG. 7 is a diagram for explaining the operation of the magnet connector shown in FIG. 1, wherein (a) is a perspective view when the connection between the receptacle connector and the plug connector has been completed and (b) is a cross-sectional view of the same.
Figure 8:
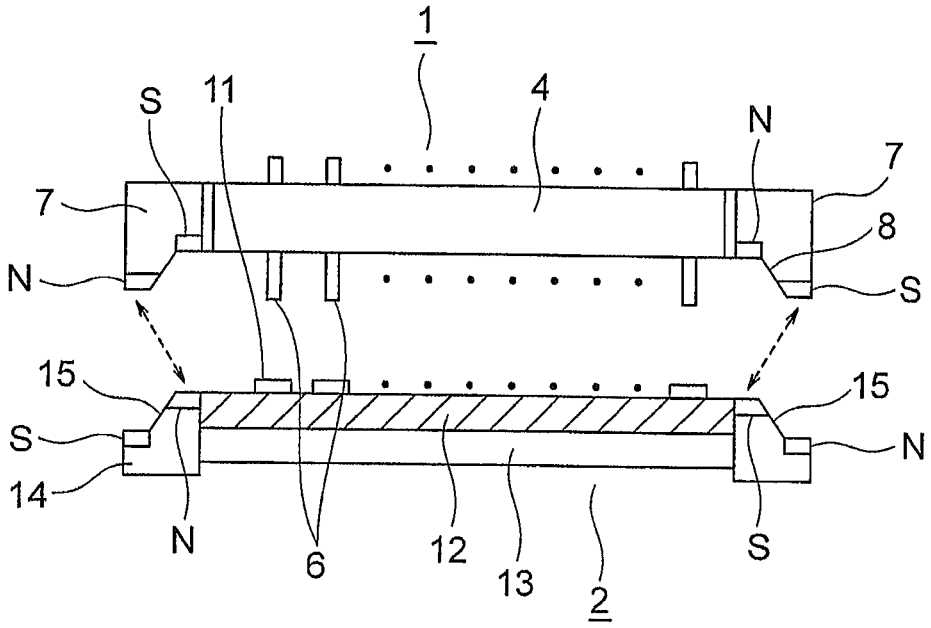
FIG. 8 is a cross-sectional view showing a magnet connector as a related art of this invention.

Thereafter, by magnetic attraction due to the opposite magnetic polarities between the first receptacle magnetic pole portion R1 (N-pole) and the first plug magnetic pole portion P1 (S-pole) and between the sixth receptacle magnetic pole portions R6 (S-poles) and the sixth plug magnetic pole portions P6 (N-poles), the insertion of the plug connector 20 into the receptacle connector 10 is completed and the connected state of the connectors 10 and 20 is held as shown at (a) and (b) in FIG. 7.

The combination of the first receptacle magnetic pole portion R1 (N-pole) and the first plug magnetic pole portion P1 (S-pole) and the combination of the sixth receptacle magnetic pole portions R6 (S-poles) and the sixth plug magnetic pole portions P6 (N-poles) can cooperatively prevent erroneous insertion in which the plug connector 20 is inserted with wrong orientation into the receptacle connector 10.

When removing the plug connector 20 from the receptacle connector 10, the plug connector 20 is pulled out of the receptacle connector 10 with a force overcoming the force of attraction due to the opposite magnetic polarities of the first receptacle magnetic pole portion R1 (N-pole) and the first plug magnetic pole portion P1 (S-pole) and the opposite magnetic polarities of the sixth receptacle magnetic pole portions R6 (S-poles) and the sixth plug magnetic pole portions P6 (N-poles) in the same manner as in the case of the conventional magnet connector. In this event, a case may occur in a final removal stage where the position offset of the plug connector 20 with respect to the receptacle connector 10 occurs in a direction crossing the connector connecting direction by magnetic repulsion due to the same magnetic polarity between the third receptacle magnetic pole portion R3 (S-pole) and the second plug magnetic pole portion P2 (S-pole) and by magnetic attraction due to the opposite magnetic polarities between the fifth receptacle magnetic pole portion R5 (N-pole) and the fourth plug magnetic pole portion P4 (S-pole). However, in this case, wiping is carried out also in the removal of the plug connector 20.

With the structure described above, the magnet connector according to this invention is such that even if dirt adheres to surfaces of the planar contacts 12 or the pin contacts 22, since the dirt is removed by wiping, it is prevented that the contact reliability is impaired, i.e. that the contact resistance increases.

In this embodiment, the receptacle connector 10 is provided with the planar contacts 12 and the plug connector 20 is provided with the pin contacts 22. However, since a receptacle connector is defined as having a receptacle housing with a recessed portion while a plug connector is defined as having a plug housing adapted to be inserted into the recessed portion of the receptacle connector, the receptacle connector may be provided with pin contacts and the plug connector may be provided with planar contacts.

While this invention has been described with reference to the embodiment, it is needless to say that various changes can be made thereto within the technical scope of this invention as defined by the claims.

What is claimed is:

1. A magnet connector which allows a plug connector, inserted into a receptacle connector, to be attracted to the receptacle connector and held in a connected state by a magnetic force, wherein the receptacle connector comprises:

a receptacle housing having a recessed portion that has a bottom surface and an inner wall surface perpendicular to the bottom surface;

a receptacle connecting surface as the bottom surface;

a receptacle contact provided at the receptacle connecting surface; and a first receptacle magnetic pole portion provided on the receptacle connecting surface, wherein the plug connector comprises:

a plug housing adapted to be inserted into the recessed portion of the receptacle connector;

a plug connecting surface, as an insertion front surface of the plug housing, adapted to be connected to the receptacle connecting surface of the receptacle connector;

a plug contact provided at the plug connecting surface; and a first plug magnetic pole portion provided on the plug connecting surface at a position adapted to face the first receptacle magnetic pole portion of the receptacle connector, wherein the recessed portion allows for a position offset of the plug connector in a direction crossing a connector connecting direction within a movement range limited by the recessed portion, wherein a biasing means is provided on a side of one of the receptacle contact and the plug contact, wherein the first receptacle magnetic pole portion and the first plug magnetic pole portion have opposite magnetic polarities, wherein the receptacle connector further comprises:

a first receptacle wall surface as the inner wall surface;

a second receptacle magnetic pole portion provided on the first receptacle wall surface in a region thereof close to the receptacle connecting surface; and a third receptacle magnetic pole portion provided on the first receptacle wall surface in another region thereof farther from the receptacle connecting surface compared to the second receptacle magnetic pole portion, wherein the plug connector further comprises:

a first plug side surface which faces the first receptacle wall surface when inserted into the receptacle connector;

a second plug magnetic pole portion provided on the first plug side surface in another region thereof close to the plug connecting surface; and a third plug magnetic pole portion provided on the first plug side surface in another region farther from the plug connecting surface compared to the second plug magnetic pole portion, wherein the second receptacle magnetic pole portion and the third receptacle magnetic pole portion have opposite magnetic polarities, wherein the second plug magnetic pole portion and the third plug magnetic pole portion have opposite magnetic polarities, wherein the second receptacle magnetic pole portion and the second plug magnetic pole portion have opposite magnetic polarities, and wherein the biasing means has a retraction margin such that the plug contact is brought into contact with the receptacle contact when the second plug magnetic pole portion faces the third receptacle magnetic pole portion and the plug connecting surface is not brought into contact with the receptacle connecting surface.

2. The magnet connector according to claim 1, wherein one of the receptacle contact and the plug contact is a pin contact with a protruding tip, and wherein the other of the receptacle contact and the plug contact is a planar contact.

3. The magnet connector according to claim 2, wherein the biasing means is provided on the pin contact.

4. The magnet connector according to claim 1, wherein the first receptacle magnetic pole portion and the second receptacle magnetic pole portion have the same magnetic polarity, and wherein the first plug magnetic pole portion and the second plug magnetic pole portion have the same magnetic polarity.

5. The magnet connector according to claim 1, wherein the receptacle connector further comprises:

a second receptacle wall surface as another inner wall surface located on a side opposite to the first wall surface of the recessed portion;

a fourth receptacle magnetic pole portion provided on the second receptacle wall surface in a region thereof close to the receptacle connecting surface; and a fifth receptacle magnetic pole portion provided on the second receptacle wall surface in another region thereof farther from the receptacle connecting surface compared to the fourth receptacle magnetic pole portion, wherein the plug connector further comprises:

a second plug side surface which faces the second receptacle wall surface when inserted into the receptacle connector;

a fourth plug magnetic pole portion provided on the second plug side surface in a region thereof close to the plug connecting surface; and a fifth plug magnetic pole portion provided on the second plug side surface in another region thereof farther from the plug connecting surface compared to the fourth plug magnetic pole portion, wherein the fourth receptacle magnetic pole portion and the fifth receptacle magnetic pole portion have opposite magnetic polarities, wherein the fourth plug magnetic pole portion and the fifth plug magnetic pole portion have opposite magnetic polarities, and wherein the fourth receptacle magnetic pole portion and the fourth plug magnetic pole portion have the same magnetic polarity.

6. The magnet connector according to claim 1, wherein the receptacle connector further comprises a sixth receptacle magnetic pole portion provided on the receptacle connecting surface, wherein the plug connector further comprises a sixth plug magnetic pole portion provided on the plug connecting surface at a position adapted to face the sixth receptacle magnetic pole portion, wherein the first receptacle magnetic pole portion and the sixth receptacle magnetic pole portion have opposite magnetic polarities, and wherein the sixth receptacle magnetic pole portion and the sixth plug magnetic pole portion have opposite magnetic polarities.

7. The magnet connector according to claim 6, wherein the receptacle housing comprises:

a receptacle insulating housing piece made of an electrically insulating material and provided with the receptacle contact; and a receptacle magnetic housing piece made of a magnetic material and having a frame shape defining the recessed portion, the receptacle magnetic housing piece having the receptacle connecting surface formed with a cutout portion which exposes the receptacle contact and part of the receptacle insulating housing piece, wherein the first to sixth receptacle magnetic pole portions are formed integrally with the receptacle magnetic housing piece by locally magnetizing corresponding portions on the receptacle magnetic housing piece, wherein the plug housing comprises:

a plug insulating housing piece made of an electrically insulating material and provided with the plug contact; and a plug magnetic housing piece made of a magnetic material and having the plug connecting surface formed with a cutout portion which exposes the plug contact and part of the plug insulating housing piece, and wherein the first to sixth plug magnetic pole portions are formed integrally with the plug magnetic housing piece by locally magnetizing corresponding portions on the plug magnetic housing piece.

8. A magnet connector which allows a plug connector, inserted into a receptacle connector, to be attracted to the receptacle connector and held in a connected state by a magnetic force, wherein the receptacle connector comprises:

a receptacle housing having a recessed portion;

a receptacle connecting surface as a bottom surface of the recessed portion of the receptacle housing;

a contact provided at the receptacle connecting surface; and a first receptacle magnetic pole portion provided on the receptacle connecting surface, wherein the plug connector comprises:

a plug housing adapted to be inserted into the recessed portion of the receptacle connector;

a plug connecting surface, as an insertion front surface of the plug housing, adapted to be connected to the receptacle connecting surface of the receptacle connector;

a contact provided at the plug connecting surface; and a first plug magnetic pole portion provided on the plug connecting surface at a position adapted to face the first receptacle magnetic pole portion of the receptacle connector, wherein a biasing means is provided on a side of one of the contact provided at the receptacle connecting surface and the contact provided at the plug connecting surface, wherein the first receptacle magnetic pole portion and the first plug magnetic pole portion have opposite magnetic polarities, wherein the receptacle connector further comprises:

a second receptacle magnetic pole portion provided in a region, close to the receptacle connecting surface, of a first receptacle wall surface as an inner wall surface of the recessed portion of the receptacle housing; and a third receptacle magnetic pole portion provided in a region, farther from the receptacle connecting surface compared to the second receptacle magnetic pole portion, of the first receptacle wall surface;

wherein the plug connector further comprises:

a second plug magnetic pole portion provided in a region, close to the plug connecting surface, of a first plug side surface which faces the first receptacle wall surface when inserted into the receptacle connector; and a third plug magnetic pole portion provided in a region, farther from the plug connecting surface compared to the second plug magnetic pole portion, of the first plug side surface;

wherein the second receptacle magnetic pole portion and the third receptacle magnetic pole portion have opposite magnetic polarities, wherein the second plug magnetic pole portion and the third plug magnetic pole portion have opposite magnetic polarities, wherein the second receptacle magnetic pole portion and the second plug magnetic pole portion have opposite magnetic polarities, wherein the receptacle connector still further comprises:

a fourth receptacle magnetic pole portion provided in a region, close to the receptacle connecting surface, of a second receptacle wall surface, located on a side opposite to the first receptacle wall surface, of the recessed portion; and a fifth receptacle magnetic pole portion provided in a region, farther from the receptacle connecting surface compared to the fourth receptacle magnetic pole portion, of the second receptacle wall surface, wherein the plug connector still further comprises:

a fourth plug magnetic pole portion provided in a region, close to the plug connecting surface, of a second plug side surface located on a side opposite to the first plug side surface and adapted to face the second receptacle wall surface when inserted into the receptacle connector; and a fifth plug magnetic pole portion provided in a region, farther from the plug connecting surface compared to the fourth plug magnetic pole portion, of the second plug side surface, wherein the fourth receptacle magnetic pole portion and the fifth receptacle magnetic pole portion have opposite magnetic polarities, wherein the fourth plug magnetic pole portion and the fifth plug magnetic pole portion have opposite magnetic polarities, and wherein the fourth receptacle magnetic pole portion and the fourth plug magnetic pole portion have the same magnetic polarity.

* * * * *